US010321244B2

(12) United States Patent
Solum

(10) Patent No.: US 10,321,244 B2
(45) Date of Patent: Jun. 11, 2019

(54) HEARING ASSISTANCE DEVICE EAVESDROPPING ON A BLUETOOTH DATA STREAM

(71) Applicant: Starkey Laboratories, Inc., Eden Prairie, MN (US)

(72) Inventor: Jeffrey Paul Solum, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 210 days.

(21) Appl. No.: 13/738,793

(22) Filed: Jan. 10, 2013

(65) Prior Publication Data

US 2014/0192988 A1 Jul. 10, 2014

(51) Int. Cl.
*H04R 25/00* (2006.01)

(52) U.S. Cl.
CPC ..... *H04R 25/552* (2013.01); *H04R 25/554* (2013.01); *H04R 25/353* (2013.01); *H04R 25/505* (2013.01); *H04R 25/558* (2013.01); *H04R 2225/55* (2013.01)

(58) Field of Classification Search
CPC .. H04R 25/552; H04R 25/554; H04R 25/558; H04R 25/353; H04R 25/505
See application file for complete search history.

(56) References Cited

U.S. PATENT DOCUMENTS 6,058,197 A 5/2000 Delage
6,694,034 B2 2/2004 Julstrom et al.
8,041,066 B2 10/2011 Solum
(Continued)

FOREIGN PATENT DOCUMENTS

EP 2200207 A1 6/2010
EP 2439962 A2 4/2012
(Continued)

OTHER PUBLICATIONS

"European Application Serial No. 14150821.8, Extended European Search Report dated Apr. 14, 2014", 6 pgs.
(Continued)

*Primary Examiner* — Tan X Dinh
(74) *Attorney, Agent, or Firm* — Schwegman Lundberg & Woessner, P.A.

(57) ABSTRACT

Disclosed herein, among other things, are systems and methods for eavesdropping on a data stream for hearing assistance devices. One aspect of the present subject matter includes a hearing assistance system for a wearer including a Bluetooth host device having a transmitter configured to send data including one or more encoded audio streams, and a data channel having an advertisement that includes frequency information, frequency hop sequences, information for decoding audio streams, and security keys for decoding audio stream information. The system also includes one or more Bluetooth slave devices identified by the Bluetooth host device. The Bluetooth slave devices are configured to actively participate in a connection with the host device to aid the host transmitter in deciding which frequencies to use for frequency hopping and in determining which frequencies are being interfered with and should not be included in a channel map, according to various embodiments.

21 Claims, 4 Drawing Sheets

(56) References Cited

U.S. PATENT DOCUMENTS

| | | | | |
|---|---|---|---|---|
| 8,041,227 | B2 | 10/2011 | Holcombe et al. | |
| 8,686,855 | B2 | 4/2014 | Popovski | |
| 2002/0044661 | A1* | 4/2002 | Jakobsson | H04L 63/067 380/270 |
| 2003/0004821 | A1* | 1/2003 | Dutta et al. | 705/26 |
| 2005/0169487 | A1 | 8/2005 | Soede et al. | |
| 2007/0249288 | A1* | 10/2007 | Moallemi et al. | 455/68 |
| 2007/0287386 | A1* | 12/2007 | Agrawal et al. | 455/67.11 |
| 2008/0146152 | A1* | 6/2008 | Hulvey et al. | 455/41.2 |
| 2008/0159548 | A1 | 7/2008 | Solum | |
| 2008/0240440 | A1* | 10/2008 | Rose et al. | 380/277 |
| 2009/0154739 | A1 | 6/2009 | Zellner | |
| 2009/0296967 | A1 | 12/2009 | Mullenborn et al. | |
| 2010/0086154 | A1* | 4/2010 | Frerking et al. | 381/315 |
| 2011/0249842 | A1 | 10/2011 | Solum et al. | |
| 2012/0087505 | A1* | 4/2012 | Popovski et al. | 381/23.1 |
| 2012/0121094 | A1 | 5/2012 | Solum | |
| 2012/0121095 | A1* | 5/2012 | Popovski et al. | 381/23.1 |
| 2013/0182650 | A1* | 7/2013 | Kezys et al. | 370/329 |
| 2013/0251180 | A1* | 9/2013 | Solum | 381/315 |
| 2013/0254050 | A1* | 9/2013 | Zhu | G06Q 20/20 705/20 |
| 2014/0056451 | A1* | 2/2014 | El-Hoiydi et al. | 381/315 |
| 2014/0105396 | A1* | 4/2014 | Engelien-Lopes | H04W 12/04 380/270 |
| 2014/0193007 | A1 | 7/2014 | Solum | |
| 2015/0319557 | A1* | 11/2015 | El-Hoiydi | H04W 4/008 455/41.2 |

FOREIGN PATENT DOCUMENTS

| | | | |
|---|---|---|---|
| EP | 2456234 | A1 | 5/2012 |
| WO | WO-2007121414 | A2 | 10/2007 |
| WO | WO-2008151624 | A1 | 12/2008 |
| WO | WO-2009126614 | A1 | 10/2009 |

OTHER PUBLICATIONS

"U.S. Appl. No. 13/738,775, Final Office Action dated Mar. 3, 2015", 12 pgs.
"U.S. Appl. No. 13/738,775, Non Final Office Action dated Sep. 25, 2014", 11 pgs.
"U.S. Appl. No. 13/738,775, Response filed Dec. 26, 2014 to Non Final Office Action dated Sep. 25, 2014", 9 pgs.
"European Application Serial No. 14150843.2, Extended European Search Report dated Apr. 8, 2014", 6 pgs.
"U.S. Appl. No. 13/738,775, Advisory Action dated Jun. 10, 2016", 5 pgs.
"U.S. Appl. No. 13/738,775, Advisory Action dated Jun. 29, 2015", 3 pgs.
"U.S. Appl. No. 13/738,775, Final Office Action dated Mar. 18, 2016", 13 pgs.
"U.S. Appl. No. 13/738,775, Non Final Office Action dated Sep. 15, 2015", 11 pgs.
"U.S. Appl. No. 13/738,775, Response filed May 18, 2016 to Final Office Action dated Mar. 18, 2016", 8 pgs.
"U.S. Appl. No. 13/738,775, Response filed Jun. 3, 2015 to Final Office Action dated Mar. 3, 2015", 8 pgs.
"U.S. Appl. No. 13/738,775, Response filed Dec. 15, 2015 to Non Final Office Action dated Sep. 15, 2015", 8 pgs.
"U.S. Appl. No. 13/738,775, Response filed Nov. 17, 2016 to Non Final Office Action dated Aug. 17, 2016", 8 pgs.
"European Application No. 14150843.2, Communication Pursuant to Article 94(3) EPC dated May 11, 2018", 6 pgs.
"European Application Serial No. 14150821.8, Communication Pursuant to Article 94(3) EPC dated May 23, 2018", 6 pgs.

* cited by examiner

HEARING ASSISTANCE DEVICE EAVESDROPPING ON A BLUETOOTH DATA STREAM

CROSS REFERENCE TO RELATED APPLICATION

This application is related to co-pending, commonly assigned, U.S. patent application Ser. No. 13/738,775, entitled "SYSTEM AND METHOD FOR OBTAINING AN AUDIO STREAM BASED ON PROXIMITY AND DIRECTION", filed on even date herewith, which is hereby incorporated by reference in its entirety.

TECHNICAL FIELD

This document relates generally to hearing assistance systems and more particularly to hearing assistance device eavesdropping on a Bluetooth data stream.

BACKGROUND

Modern hearing assistance devices, such as hearing aids, typically include digital electronics to enhance the wearer's listening experience. Hearing aids are electronic instruments worn in or around the ear that compensate for hearing losses by specially amplifying sound. Hearing aids use transducer and electro-mechanical components which are connected via wires to the hearing aid circuitry.

Hearing assistance devices include the capability to receive audio from a variety of sources. For example, a hearing assistance device may receive audio or data from a transmitter or streamer of an assistive listening device (ALD). Data such as configuration parameters and telemetry information can be downloaded and/or uploaded to the instruments for the purpose of programming, control and data logging. Audio information can be digitized, packetized and transferred as digital packets to and from the hearing instruments for the purpose of streaming entertainment or other content.

Accordingly, there is a need in the art for improved systems and methods for eavesdropping on a data stream for hearing assistance devices.

SUMMARY

Disclosed herein, among other things, are systems and methods for eavesdropping on a data stream for hearing assistance devices. One aspect of the present subject matter includes a hearing assistance system for a wearer including a Bluetooth host device having a transmitter configured to send data including one or more encoded audio streams, and a data channel having an advertisement that includes frequency information, frequency hop sequences, information for decoding audio streams, and security keys for decoding audio stream information. The system also includes one or more Bluetooth slave devices identified by the Bluetooth host device. The Bluetooth slave devices are configured to actively participate in a connection with the host device to aid the host transmitter in deciding which frequencies to use for frequency hopping and in determining which frequencies are being interfered with and should not be included in a channel map, according to various embodiments.

One aspect of the present subject matter includes a method of using a Bluetooth receiver including receiving a data stream from a Bluetooth host device including a transmitter, the data stream including advertisements, frequency hop code sequences and security codes. According to various embodiments, the method also includes passively listening on potential channels for interference to decide which frequencies can be used for frequency hopping.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1:
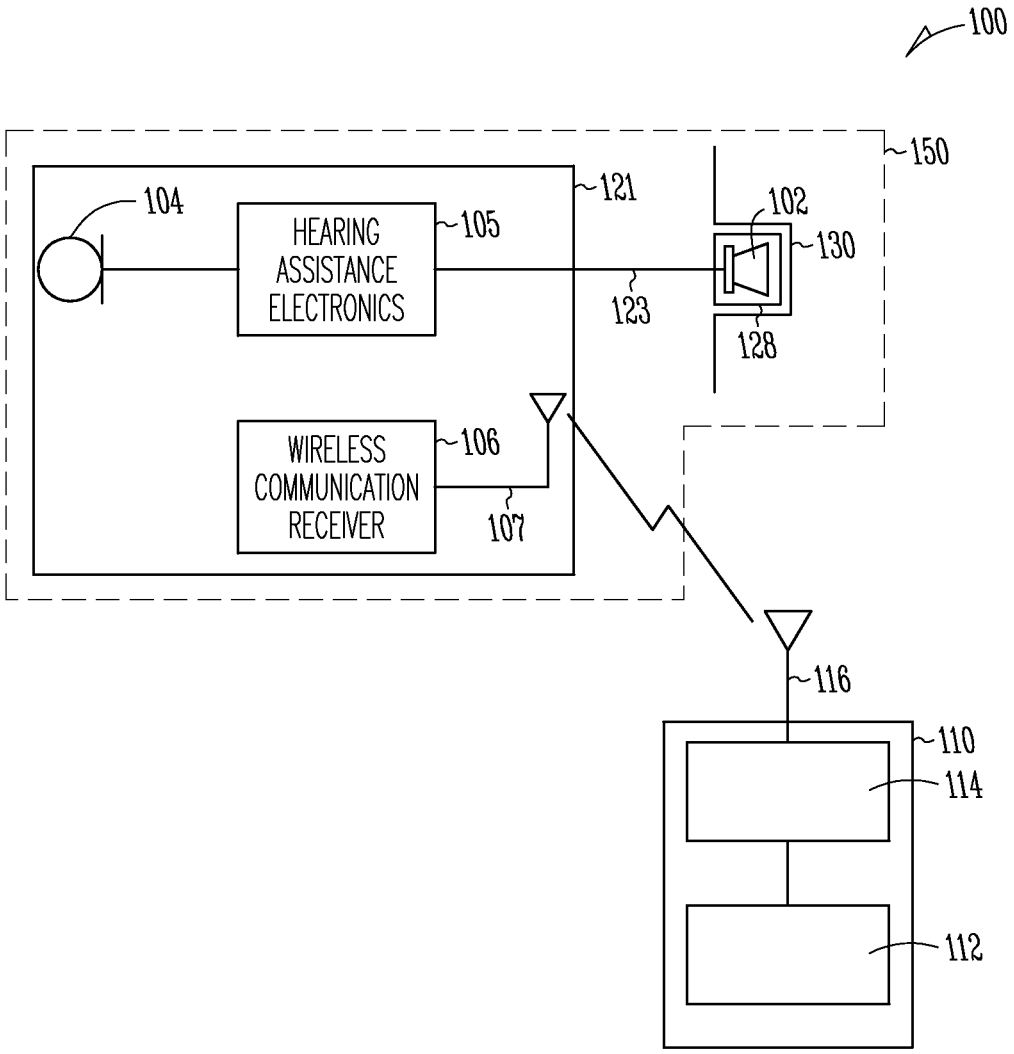
FIG. 1 illustrates a block diagram of a system including a hearing assistance device adapted to be worn by a wearer and an external Bluetooth host device, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing assistance devices include the capability to receive audio from a variety of sources. For example, a hearing assistance device may receive audio or data from a transmitter or streamer from an external device, such as an assistive listening device (ALD). Data such as configuration parameters and telemetry information can be downloaded and/or uploaded to the instruments for the purpose of programming, control and data logging. Audio information can be digitized, packetized and transferred as digital packets to and from the hearing instruments for the purpose of streaming entertainment, carrying on phone conversations, playing announcements, alarms and reminders. In one embodiment, music is streamed from an external device to a hearing assistance device using a wireless transmission. Types of wireless transmissions include, but are not limited to, 802.11 (WIFI), Bluetooth or other means of wireless communication with a hearing instrument.

There is a need in the art for improved systems and methods for obtaining an audio stream for hearing assistance devices. Previous solution included proprietary modes of operation to determine the frequency of operation of an assistive listening device, such as using magnetic inductive receivers to obtain information about the frequency of a narrowband FM signal Disclosed herein, among other things, are systems and methods for eavesdropping on a data stream for hearing assistance devices. One aspect of the present subject matter includes a hearing assistance system for a wearer including a Bluetooth host device having a transmitter configured to send data including one or more encoded audio streams, and a data channel having an advertisement that includes frequency information, frequency hop sequences, information for decoding audio streams, and security keys for decoding audio stream information. The system also includes one or more Bluetooth slave devices identified by the Bluetooth host device. The Bluetooth slave devices are configured to actively participate in a connection with the host device to aid the host transmitter in deciding which frequencies to use for frequency hopping and in determining which frequencies are being interfered with and should not be included in a channel map, according to various embodiments.

The present subject matter allows devices to receive a data stream when they are determined to be in close proximity and direction of an audio field, as determined by a host device. An example of this determination can be found in co-pending, commonly assigned, U.S. patent application Ser. No. 13/738,775, entitled "SYSTEM AND METHOD FOR OBTANING AN AUDIO STREAM BASED ON PROXIMITY AND DIRECTION", which is hereby incorporated by reference in its entirety.

One aspect of the present subject matter provides a system and method for multiple users to receive a data stream for audio without being in a connection with the device that is hosting the information. This subject matter provides a significant deviation to any of the Bluetooth Core Specifications, which require the devices communicating to be in a two-way connection. Bluetooth is a widely used standard that has not yet included multi-cast and broadcast modes of operation. The present subject matter allows devices to receive a data stream without being in a one to one connection with the host device.

In various embodiments, the host device can be a standard Bluetooth radio type device using adaptive frequency hopping techniques while allowing other uses to participate in receiving the information. The present subject matter allows a standard based approach and a single physical layer in the hearing instrument to receive a broadcast communication over a long range without having to transmit back to a host device, in various embodiments. In previous solutions, if the hearing instrument would need to communicate with the host device over a long range, it would need a large antenna and a much larger energy source than is typically available in a hearing instrument. One example includes multiplex cinema where multiple audio sources may be available.

One aspect of the present subject matter includes methods of obtaining necessary parameters to participate in a Bluetooth audio transmission. Once a hearing aid wearer is identified to be in proximity and moving in the direction of an audio field, a device user (such as a hearing aid wearer) is given the Bluetooth access address, frequency, hop sequence, security keys, cipher codes, etc., necessary to receive the signal being sent from within the area of the audio field. In addition, the user will be given the necessary information to begin hopping in sequence with the host device. Since the devices are worn on each ear, in an embodiment, the user also obtains the necessary information to listen to both a right and left channel simultaneously on a right and left worn hearing instrument for the purpose of stereo reception. Any delay between left and right channels is also sent to the device user to aid in the synchronization of the rendering of each channel to allow for synchronized stereo listening, in various embodiments. According to various embodiments, channel map information is advertised by the master device periodically, which allows devices that have lost synchronization to reacquire the signals.

According to various embodiments, in order to facilitate adaptive frequency hopping, the host device uses passive listening between transmissions to determine if the channels being used for hopping should be modified to avoid interference. In another embodiment, another Bluetooth transceiver (or transceivers, one for each audio channel) are used and are in communication with the host device to determine through acknowledgements whether the channels being used should be modified due to apparent interference. The device receiving the signals uses the same addresses as the devices used to determine "good" channels for communication within an auditorium, for example. The "master receivers" can be either collocated with the host transceiver device(s) or be remotely located to better simulated devices located throughout the sound area, in various embodiments.

In one embodiment, the present subject matter uses the same physical layer within the hearing instrument for transmitting and receiving signals wirelessly, such as Bluetooth or Bluetooth low energy. The present subject matter utilizes the proximity sensor profile within Bluetooth low energy, in an embodiment. In various embodiments, this can be used with a security key (digital rights management) to make the system more robust.

FIG. 1 illustrates a block diagram of a system 100, according to the present subject matter. The illustrated system 100 shows an external Bluetooth device 110 in wireless communication with a hearing assistance device 150. In various embodiments, the hearing assistance device 150 includes a first housing 121, an acoustic receiver or speaker 102, positioned in or about the ear canal 130 of a wearer and conductors 123 coupling the receiver 102 to the first housing 121 and the electronics enclosed therein. The electronics enclosed in the first housing 121 includes a microphone 104, hearing assistance electronics 105, a wireless communication receiver 106 and an antenna 107. In various embodiments, the hearing assistance electronics 105 includes at least one processor and memory components. The memory components store program instructions for the at least one processor. The program instructions include functions allowing the processor and other components to process audio received by the microphone 304 and transmit processed audio signals to the speaker 102. The speaker or receiver emits the processed audio signal as sound in the user's ear canal. In various embodiments, the hearing assistance electronics includes functionality to amplify, filter, limit, condition or a combination thereof, the sounds received using the microphone 104.

In the illustrated embodiment of FIG. 1, the wireless communications receiver 106 includes a Bluetooth receiver connected to the hearing assistance electronics 105 and the conductors 123 connect the hearing assistance electronics 105 and the speaker 102. In various embodiments, the external device 110 includes a Bluetooth streaming audio device such as an ALD. The external device 110 includes an antenna 116 connected to processing electronics 114 that include a transmitter, in an embodiment. In various embodiments, the external device 110 includes one or more sensors 112 or sensing components connected to the processing electronics 114 to sense proximity and direction of the hearing assistance device 150.

Figure 2:
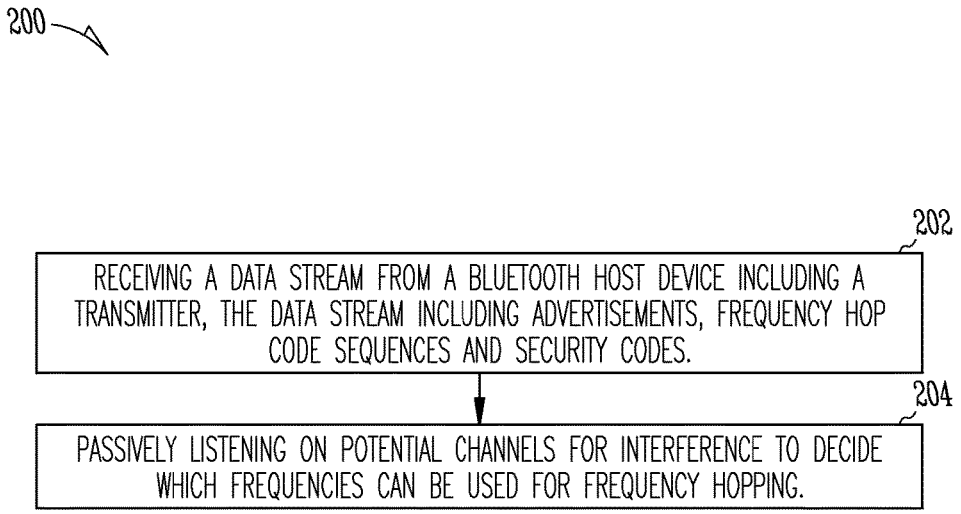
FIG. 2 illustrates a flow diagram of a method of using a Bluetooth receiver, according to various embodiments of the present subject matter.

FIG. 2 illustrates a flow diagram of a method of using a Bluetooth receiver, according to various embodiments of the present subject matter. One aspect of the present subject matter includes a method 200 of using a Bluetooth receiver including, at 202, receiving a data stream from a Bluetooth host device including a transmitter, the data stream including advertisements, frequency hop code sequences and security codes. According to various embodiments, the method also includes passively listening on potential channels for interference to decide which frequencies can be used for frequency hopping, at 204.

Figure 3:
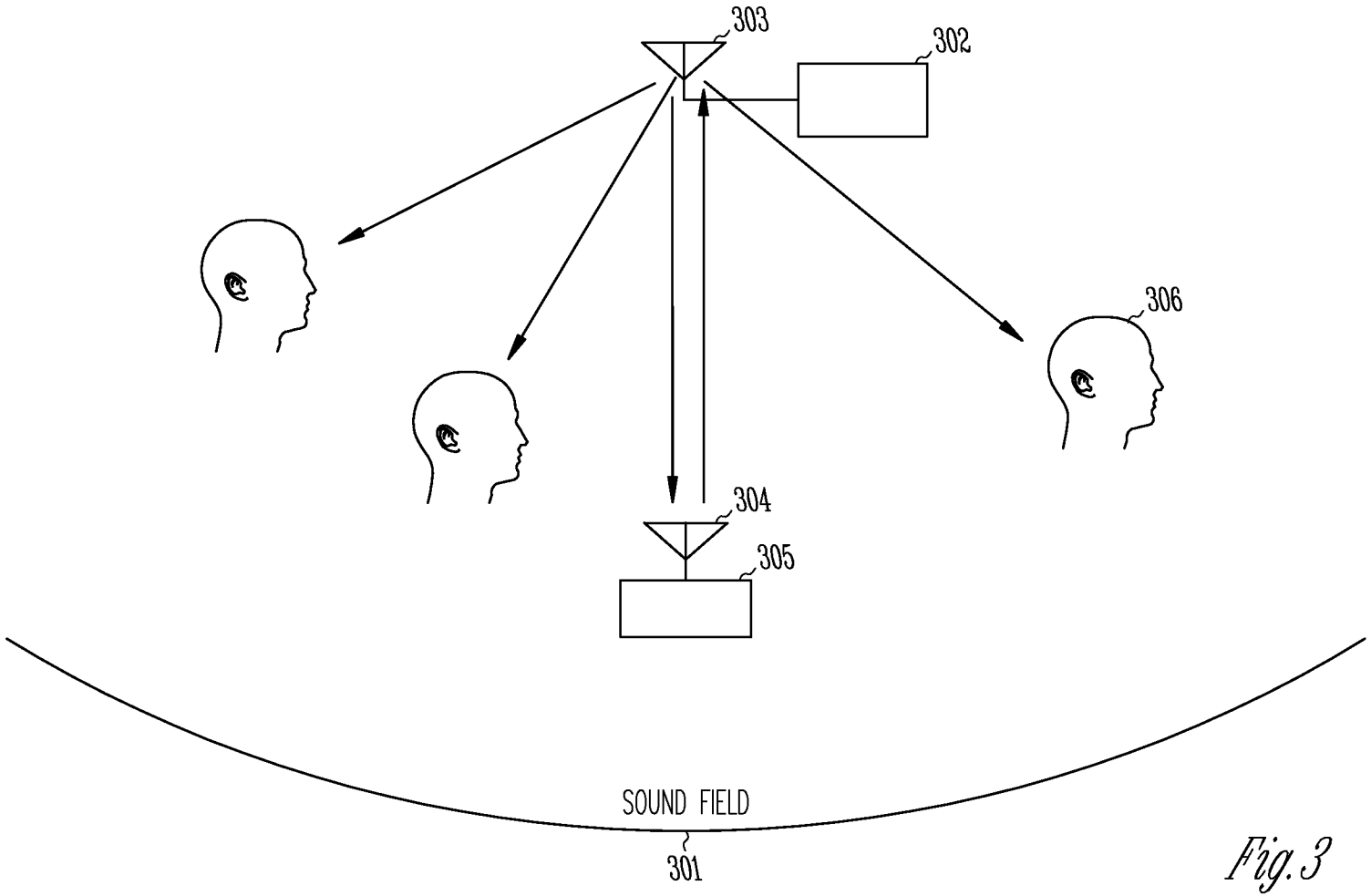
FIG. 3 illustrates a diagram of a system in which a host device is physically connected to an antenna, according to various embodiments of the present subject matter.

FIG. 3 illustrates an embodiment of the present subject matter in which a host transceiver device 302 is physically connected to an antenna 303. In one embodiment, the host device 302 is in two-way communication with slave device 305 which is connected to antenna 304. The communication between host device 302 and slave device 305 is maintained using adaptive frequency hopping techniques to avoid congestion and interference, according to various embodiments. Hearing assistance devices are worn by wearers 306 and are configured to eavesdrop on the connection between host device 302 and slave device 305, in various embodiments. In various embodiments, stereo channels can be sent together or as separate radio frequency (RF) streams of information to the devices in sound field 301. A separate advertising channel is used to inform the listeners of the current frequency hopping and timing sequence of the usable RF channels carrying the audio information for both left and right audio channels, in various embodiments. The advertising channels contain all necessary information to demodulate and decode the audio information, in various embodiments. Such information includes, but is not limited to: a frequency hopping channel map, timing information, spreading codes, security keys and modulation type.

Figure 4:
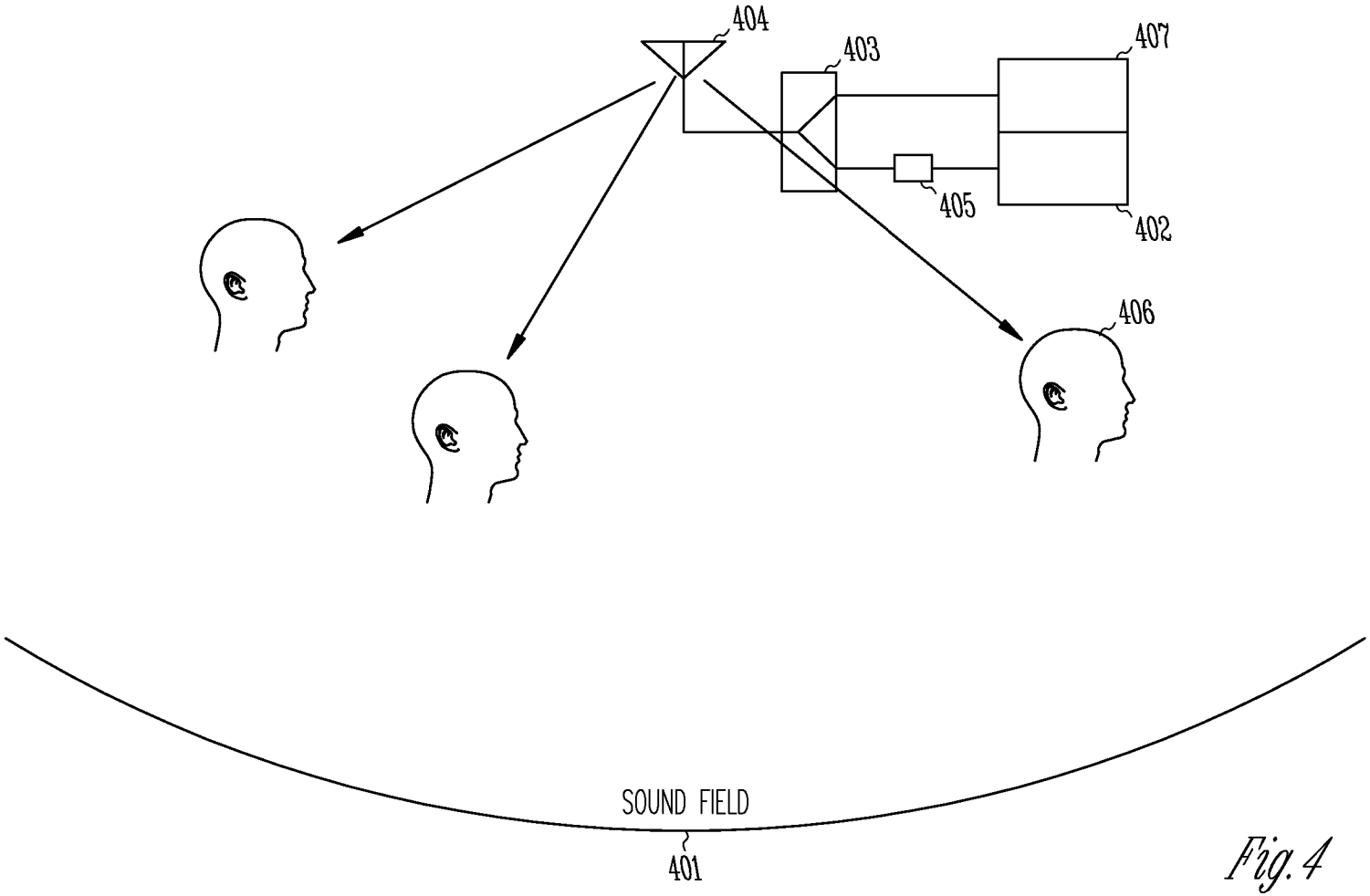
FIG. 4. Illustrates a diagram of a system in which a slave device is collocated with a host device which shares the same antenna, according to various embodiments of the present subject matter.

FIG. 4 illustrates an alternate embodiment where the slave device 402 is collocated with the host device 407 which shares the same antenna 404. In this embodiment, the slave device and host device are connected to antenna 404 through a combiner 403. The signal from the host device to the slave device is attenuated by the isolation of the splitter and through attenuator 405 such that the signal is near the limit of sensitivity for slave device 402, in an embodiment. In various embodiments, interference from other devices using the spectrum is picked up by antenna 404 so that slave device 402 picks up both the wanted signal from the host device and any interference. As in FIG. 3, the hearing instrument wearers are eavesdropping on the host transmissions to the slave device 402. The stereo channels can be sent together or as separate RF streams of information to the devices in sound field 401, in various embodiments. According to various embodiments, a separate advertising channel is used to inform the listeners of the current frequency hopping and timing sequence of the usable RF channels carrying the audio information for both left and right audio channels. The advertising channels can contain all necessary information to demodulate and decode the audio information, in various embodiments. Such information includes, but is not limited to: a frequency hopping channel map, timing information, spreading codes, security keys and modulation type.

Various embodiments of the present subject matter support wireless communications with a hearing assistance device. In various embodiments the wireless communications can include standard or nonstandard communications. Some examples of standard wireless communications include link protocols including, but not limited to, Bluetooth™, IEEE 802.11 (wireless LANs), 802.15 (WPANs), 802.16 (WiMAX), cellular protocols including, but not limited to CDMA and GSM, ZigBee, and ultra-wideband (UWB) technologies. Such protocols support radio frequency communications and some support infrared communications. Although the present system is demonstrated as a radio system, it is possible that other forms of wireless communications can be used such as ultrasonic, optical, infrared, and others. It is understood that the standards which can be used include past and present standards. It is also contemplated that future versions of these standards and new future standards may be employed without departing from the scope of the present subject matter.

The wireless communications support a connection from other devices. Such connections include, but are not limited to, one or more mono or stereo connections or digital connections having link protocols including, but not limited to 802.3 (Ethernet), 802.4, 802.5, USB, SPI, PCM, ATM, Fibre-channel, Firewire or 1394, InfiniBand, or a native streaming interface. In various embodiments, such connections include all past and present link protocols. It is also contemplated that future versions of these protocols and new future standards may be employed without departing from the scope of the present subject matter.

It is understood that variations in communications protocols, antenna configurations, and combinations of components may be employed without departing from the scope of the present subject matter. Hearing assistance devices typically include an enclosure or housing, a microphone, hearing assistance device electronics including processing electronics, and a speaker or receiver. It is understood that in various embodiments the microphone is optional. It is understood that in various embodiments the receiver is optional. Antenna configurations may vary and may be included within an enclosure for the electronics or be external to an enclosure for the electronics. Thus, the examples set forth herein are intended to be demonstrative and not a limiting or exhaustive depiction of variations.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, audio decoding, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance system for a wearer, comprising:

a Bluetooth host device including a transmitter configured to send data including one or more encoded audio streams to one or more Bluetooth slave devices, and a data channel having an unencoded advertisement that includes frequency information, frequency hop sequences, information for decoding audio streams, and security keys for decoding audio stream information, the one or more Bluetooth slave devices paired with the Bluetooth host device and configured to actively participate in a bidirectional connection with the host device to aid the host transmitter in deciding which frequencies to use for frequency hopping and in determining which frequencies are being interfered with and should not be included in a channel map, wherein the Bluetooth host device and at least one of the one or more Bluetooth slave devices share an antenna; and one or more hearing assistance devices not paired with the Bluetooth host device and configured to receive the unencoded advertisement, the one or more hearing assistance devices configured to use the frequency information and the frequency hop sequences to eavesdrop on the connection between the Bluetooth host device and the one or more slave devices paired with the Bluetooth host device, the one or more hearing assistance devices configured to use information from the advertisement to begin frequency hopping in sequence with the host device and to receive the audio streams, and unencode the audio streams without having to transmit back to the Bluetooth host device.

2. The system of claim 1, wherein the one or more Bluetooth slave devices are adapted to receive and decode the audio streams or other data information after receiving the advertised frequency information and other information used to synchronize and decode receptions from the host device.

3. The system of claim 2, wherein at least one of the Bluetooth slave devices is included in a hearing assistance device.

4. The system of claim 3, wherein the hearing assistance device includes a hearing aid.

5. The system of claim 4, wherein the hearing aid includes an in-the-ear (ITE) hearing aid.

6. The system of claim 4, wherein the hearing aid includes a behind-the-ear (BTE) hearing aid.

7. The system of claim 4, wherein the hearing aid includes an in-the-canal (ITC) hearing aid.

8. The system of claim 4, wherein the hearing aid includes a receiver-in-canal (RIC) hearing aid.

9. The system of claim 4, wherein the hearing aid includes a completely-in-the-canal (CIC) hearing aid.

10. The system of claim 4, wherein the hearing aid includes a receiver-in-the-ear (RITE) hearing aid.

11. A method of using a Bluetooth receiver, comprising:

receiving a data stream from a Bluetooth host device without pairing the Bluetooth receiver to the Bluetooth host device, the Bluetooth host device including a transmitter, the data stream including unencoded advertisements, frequency hop code sequences and security codes; and passively listening on potential channels, including receiving the unencoded advertisement, and using information from the unencoded advertisements and the frequency hop sequences to eavesdrop on a connection between the Bluetooth host device and a slave device paired with the Bluetooth host device, and using information from the advertisements to begin frequency hopping in sequence with the host device and to receive audio streams, and unencode the audio streams without having to transmit back to the Bluetooth host device, wherein the Bluetooth host device and the slave device share an antenna.

12. The method of claim 11, wherein receiving a data stream from a Bluetooth host device includes receiving a channel map.

13. The method of claim 12, wherein receiving a channel map from a Bluetooth host device includes receiving the channel map periodically to reacquire signals if the Bluetooth receiver has lost synchronization with the Bluetooth host device.

14. The method of claim 11, wherein receiving a data stream from a Bluetooth host device includes receiving cipher codes.

15. The method of claim 11, wherein receiving a data stream from a Bluetooth host device includes receiving information to begin hopping in sequence with the Bluetooth host device.

16. The method of claim 11, wherein receiving a data stream from a Bluetooth host device includes receiving information to listen to both a right and left channel.

17. The method of claim 16, wherein the tight and left channel include data for left and right worn hearing assistance devices.

18. The method of claim 17, wherein the hearing assistance devices include hearing aids.

19. The method of claim 16, further comprising receiving data indicative of delay between the right and left channels.

20. The method of claim 19, further comprising using the data indicative of delay to synchronize a rendering of each channel to allow for synchronized stereo listening.

21. The method of claim 11, wherein receiving a data stream from a Bluetooth host device includes receiving an address to listen.

* * * * *